United States Patent [19]

Armstrong

[11] Patent Number: 4,570,530

[45] Date of Patent: Feb. 18, 1986

[54] WORKPIECE ALIGNMENT SYSTEM

[75] Inventor: Lee R. Armstrong, Middlesex County, Mass.

[73] Assignee: RCA Corporation, Princeton, N.J.

[21] Appl. No.: 561,175

[22] Filed: Dec. 14, 1983

[51] Int. Cl.[4] ..... F41G 5/24; H04N 3/36

[52] U.S. Cl. ..... 89/41.05; 89/41.09; 358/108

[58] Field of Search ..... 89/41.05, 41.09, 41.01; 358/108

[56] References Cited

U.S. PATENT DOCUMENTS

| | | | |
|---|---|---|---|
| 3,640,178 | 2/1972 | Chatham et al. | 89/41.09 |
| 3,711,638 | 1/1973 | Davies | 89/41.05 X |
| 3,803,387 | 4/1974 | Lackowski | 89/41.09 X |
| 3,844,196 | 10/1974 | Taylor et al. | 89/41.09 |
| 3,854,378 | 12/1974 | Vogel | 89/41.09 X |
| 3,997,762 | 12/1976 | Ritchie et al. | 89/41.05 X |
| 4,318,330 | 3/1982 | Hausenblas | 89/41.05 |
| 4,370,914 | 2/1983 | Voles | 89/41.05 |
| 4,418,360 | 11/1983 | Glasgow | 358/108 |

FOREIGN PATENT DOCUMENTS

| | | | |
|---|---|---|---|
| 1564597 | 4/1980 | United Kingdom | 89/41.09 |

*Primary Examiner*—David H. Brown

*Attorney, Agent, or Firm*—Joseph S. Tripoli; Robert L. Troike; Raymond E. Smiley

[57] ABSTRACT

A video camera or similar scene observing device, mounted on a movable workpiece to be aligned with a target, views the scene that the workpiece is directed toward. A video viewing device is receptive of signals from the observing device for displaying a portion of the field of view on the viewing device and is receptive of a position error signal for controlling what portion of the field of view is displayed. First and second signals are produced representing the desired rate of movement of the workpiece and actual rate of movement of the workpiece, respectively. The difference between these signals is integrated to produce the position error signal. Therefore, the viewed scene moves only in response to the signal indicative of the desired rate of movement. If there is no desired rate of movement, the image appears stationary on the viewing device even though the workpiece may be oscillating about a desired position.

14 Claims, 2 Drawing Figures

WORKPIECE ALIGNMENT SYSTEM

This invention relates to a system for aligning a workpiece with a target, and more particularly, to such a system involving means for artifically stabilizing the view of the target as seen from the workpiece by utilizing a display screen.

BACKGROUND OF THE INVENTION

In systems in which a workpiece has to be aligned with a target and which is positioned by operations performed by a remotely located operator it is known to have optics or a television camera mounted on the workpiece with optical or electronic coupling to viewing optics or a viewing screen in the remote location allowing the remotely positioned operator to observe the workpiece being aligned with the target.

In some instances the workpiece is caused to bounce around relative to the target. One such example is a military tank where the workpiece is the tank gun movable in azimuth and elevation relative to the tank body, the target is whatever the tank gunner decides to shoot at, but, when the tank moves, the gun bounces. Therefore, the operator located inside the tank body sees a bouncy image on his imager (optics or TV screen) making it difficult to align the gun with the target. The solution heretofore utilized has been to gyrostabilize the gun to eliminate bouncing. This is very costly both in terms of hardware and weight.

SUMMARY OF THE INVENTION

In accordance with a preferred embodiment of the present invention a system for aligning a workpiece, remotely controlled in movement, with a desired target comprises the combination of an electronic scene observing first means such as a television camera adapted for movement with the workpiece for viewing whatever target the workpiece is aligned with, an electronic scene viewing second means such as a TV monitor capable of displaying a portion less than all of the scene observed by the scene observing means and having control terminal means responsive to a control signal for determining which portion of the viewed scene is displayed on said display means, third means for producing a first signal indicative of the rate of movement of said workpiece, fourth means producing a second signal indicative of a desired rate of movement of said workpiece and fifth means responsive to the first signal and second signal for producing the control signal for causing the viewed image to move only at a rate set by said third means whereby when said third means is set to indicate a zero rate of workpiece movement said viewed image is stationary even though said workpiece still may be in motion.

DETAILED DESCRIPTION

Figure 1:
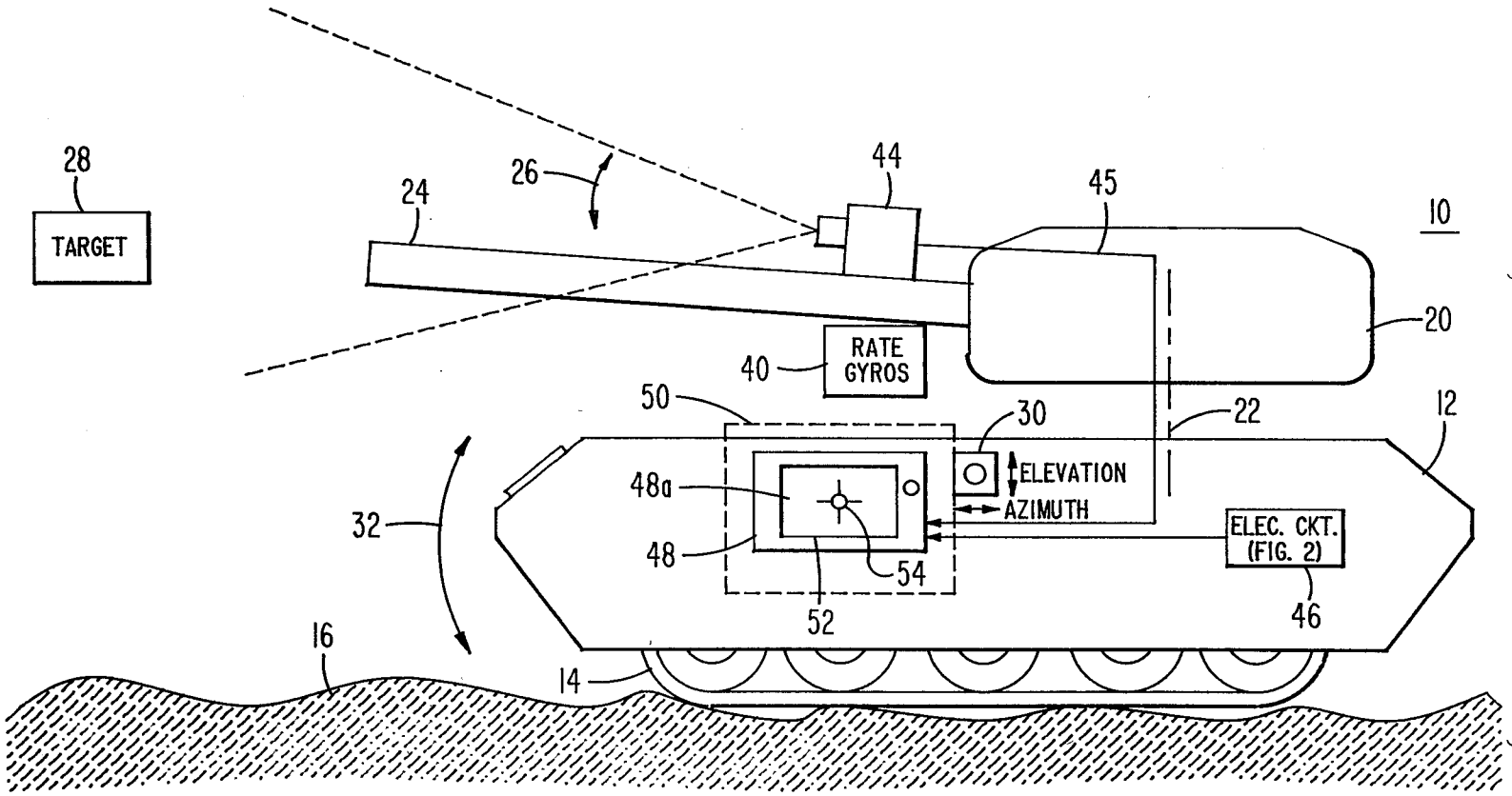
FIG. 1 illustrates a tank utilizing the workpiece alignment system of the present invention.

Referring to FIG. 1 a tank 10 used by combat forces comprises a tank body 12, tank treads 14 (only one visible) rotatably mounted thereto for causing movement of the tank over terrain surface 16, a turret 20 rotatable about axis 22 relative to tank body 12, and a gun 24 pivotable about turret 20 in the direction indicated by double-ended arrow 26. Gun 24 is aimed at target 28 by a control handle 30 which is moved in a direction and distance to indicate a direction and desired rate of movement of gun 24. There is a center rest position for control handle 30 which corresponds to no desired movement of gun 24. The tank may include more than one gun but one gun serves to illustrate the invention.

As tank 10 moves over surface 16, which is often rough, tank body 12 tends to bounce up and down as indicated by double-ended arrow 32 and to a lesser extent from side to side. In the prior art gun 24 had to be completely stabilized to be of use such that it would point steadily at target 28 even with the bouncing tank. In accordance with the invention to be described hereinafter the gun does not need to be completely stabilized.

In accordance with the invention, rate gyros 40 are functionally or physically attached to the gun 24 to produce signals corresponding to transverse (side to side) movement of the gun and elevational (up and down) movement of the gun as a function of time. These rate gyros may also be part of such gun stabilization system as exists on a tank using prior art stabilization systems. A sensor 44 such as a television camera, an infrared sensor or radar sensor is mounted on gun 24 in alignment therewith for movement therewith. Optionally, optics may be mounted on the gun and mechanically connected to a remotely mounted television camera or infrared sensor. Hereinafter, sensor 44 is assumed to be a gun mounted television camera. When gun 24 is aimed at target 28, for example, the target is also centered or at least approximately centered in the field of view of camera 44.

Camera 44 is connected via lead 45 to television monitor 48 located within tank body 12. The monitor is for use by a tank gunner (not illustrated) to aim gun 24 at a desired target. Dashed line 50 surrounding monitor 48 indicates the field of view of camera 44 relative to that of monitor 48 in which the field of view is as defined by screen bezel 52. Circuit 46 (illustrated in detail in FIG. 2) is also connected to monitor 48. The purpose of circuit 46 (to be described hereinafter) is to control which portion of the viewed scene depicted by dashed line 50 is actually displayed on monitor 48. An aiming reticle 54 may be permanently positioned at a desired place on the screen 48*a* of monitor 48 for use in aligning gun 24 with any desired target 28.

Figure 2:
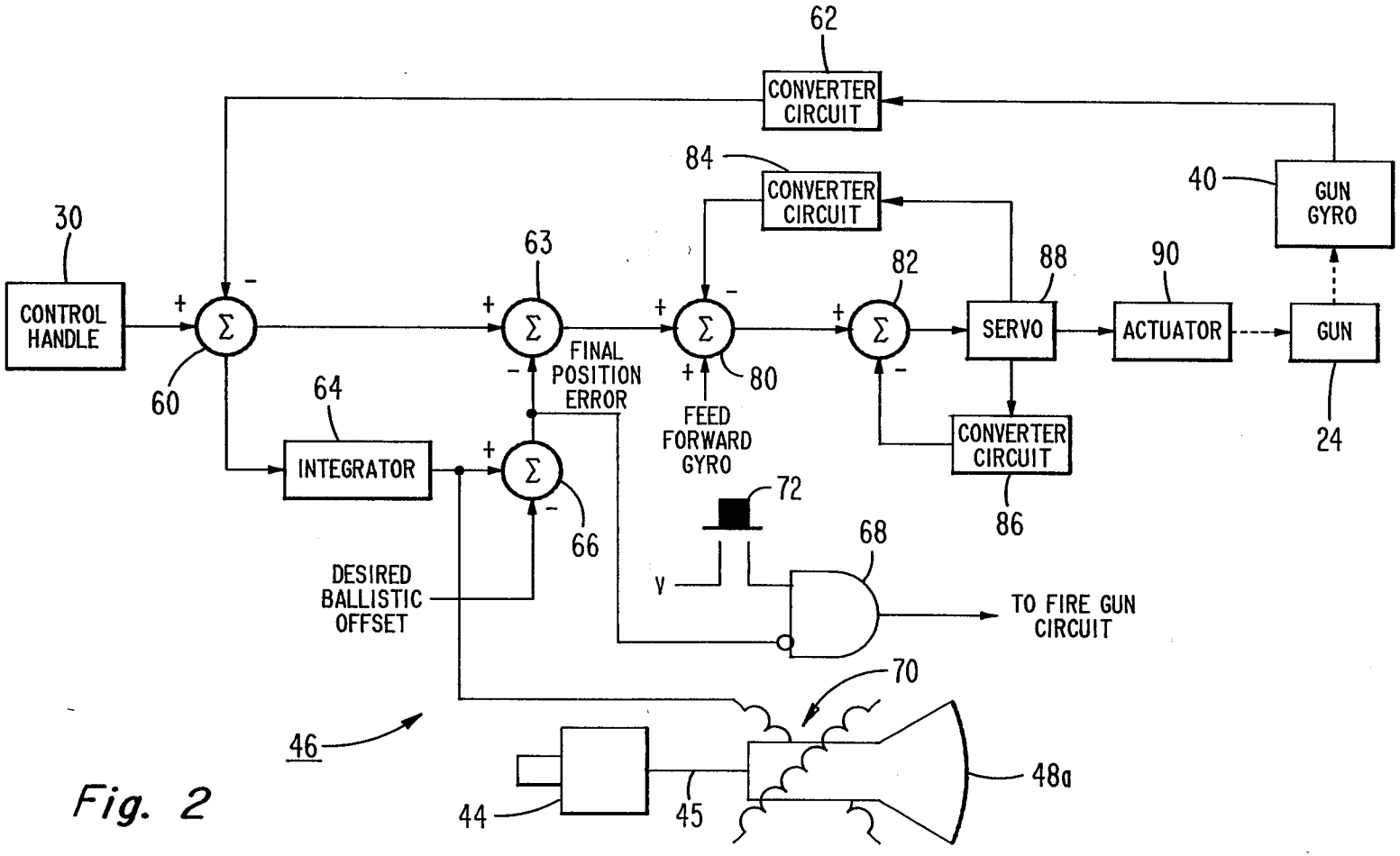
FIG. 2 is a workpiece alignment system in electrical block schematic form in accordance with the present invention.

With reference to FIG. 2 the circuit 46 therein illustrated is one of two identical circuits. There is one such circuit associated with azimuth motion of gun 24 (FIG. 1) and one associated with elevation motion of gun 24. The purpose of the circuits is to scroll left and right—up and down the video scene as viewed on monitor 48 (FIG. 1) relative to the scene monitored by camera 44 such that the video scene moves only when control handle 30 is moved to indicate desired motion of gun 24 and otherwise remains steady even when gun 24 bounces. It will be understood that the term "steady" does not preclude scene changes only in accordance with motion of the tank over terrain 16. Handle 30 produces two direct current signals for directing movement of gun 24 in azimuth and elevation respectively. (It will be remembered that there is a circuit 46 to control azimuth motions of gun 24 and a similar circuit 46 to control elevational motions thereof). The amplitude and polarity of the signals produced by handle 30 is indicative of degrees of angular motion per unit time (in azimuth or elevation) that gun 24 is desired to be moved. An exemplory figure is 5 millivolts/degree/-second. Control handle 30 is coupled to a summing node circuit 60. Gun gyro 40, a rate sensing gyro of conventional design (one of two—an elevation motion sensing gyro and an azimuth sensing gyro), is mechanically coupled to gun 24 to detect motion thereof and to produce a signal which corresponds to the rate of gun motion in azimuth or elevation. Gun gyro 40 typically produces a 400 hertz signal amplitude and phase modulated in accordance with the rate and direction respectively of movement of gun 24.

Gyro 40 is coupled to a signal converter circuit 62 such as a feedback transfer function circuit. One suitable type of function transfer circuit is a feedback multiplier circuit. Circuit 62 converts the frequency signal produced by gyro 40 to indicate the rate of angular movement of gun 24 in azimuth or elevation to a direct current signal the amplitude and polarity of which represent the rate of gun movement in degrees per second. The output of circuit 62 is coupled to an inverting second input of summing node circuit 60. Summing node circuit 60 typically comprises two resistors coupled to receive the two input signals and connected to an operational amplifier, the output of which is connected to the output of the summing node circuit. Summing node circuit 60 subtracts the voltage produced by circuit 62 representing the actual rate of movement of gun 24 in azimuth or elevation from the voltage produced by control handle 30 representing the desired rate of angular movement of gun 24 thus generating a voltage which represents the difference between the desired rate of motion and the actual rate of motion of gun 24. Summing node circuit 60 is coupled to a second summing node circuit 63 and to an integrating circuit 64. Integrating circuit 64 converts the rate error voltage signals produced at summing node circuit 60 to voltage signals representing angular position error of gun 24. Integrating circuit 64 is coupled to a third summing node circuit 66 to pass position error voltage signals thereto and to a deflection yoke 70 (horizontal or vertical) of CRT 48*a*. CRT 48*a* is the display screen part of monitor 48 (FIG. 1). The deflection yoke 70 is also connected to conventional electron beam deflection circuitry (not shown). Camera 44 is connected to the intensity modulation input of CRT 48*a* utilizing conventional circuitry. The signal from integrator 64 provides an offset deflection voltage to CRT 48*a* to determine what part of the scene viewed by camera 44 is displayed on CRT 48*a*. A desired ballistic offset signal is also coupled to an inverting input terminal of summing node circuit 66. This signal has a value which is dependent on target range, wind and atmospheric conditions and type of ammunition being utilized, among other conditions and is generated by means not of interest in the invention. The offset signal is subtracted from the position error signal produced by integrator 64, the result being a final position error signal at the output of summing node circuit 66.

The output signal from summing node circuit 66 is connected to an inverting input of summing node circuit 63 and to the inverting input (the inverting input is illustrated as a circle) of AND gate 68. A second input to gate 68 is a normally open fire control button 72 which, when closed, couples a voltage V to gate 68. The output of gate 68 is coupled to fire gun circuits of conventional design and not shown. Thus only when there is a zero final position error signal from summing node circuit 66 and when fire control button 72 is depressed, is gun 24 fired.

The remaining elements: summing node circuits 80 and 82, converter circuits 84 and 86 (of design similar to circuit 62) servo 88 and gun actuator 90, are of conventional design and arrangement, form no part of the invention except to provide a signal path to position gun 24, are illustrated only for circuit completeness and will not be described further. The feedforward gyro signal applied to summing node circuit 80 comes from a turret 20 mounted gyro (not gyro 40) and aids in damping movement of gun 24.

Operation will be described for three assumed phases of operation. First, assuming that gun 24 is aligned with a desired target 28 and not in motion, second that the gun is nominally misaligned with the target only by the amount of desired ballistic offset but is bouncing around, and third that the gun is in the process of being aligned with the desired target. This order is the reverse of a typical scenario but is chosen for ease in understanding the system operation.

With the first assumed phase, that is the gun 24 aligned with target 28 and not in motion, control handle 30 produces a zero voltage corresponding to a zero desired rate of gun 24 movement which voltage is applied to the noninverting input of summing node 60. Since gun 24 is assumed to be stationary, circuit 62 produces zero voltage corresponding to a zero actual rate of gun 24 movement which voltage is applied to the inverting input of summing node circuit 60. Summing node circuit 60 thus produces a zero output voltage signal. Integrator 64 also produces a zero output signal which is applied to summing node circuit 66 and to yoke 70. Therefore, the system is adjusted such that, on CRT 48*a*, target 28 appears centered at reticle 54 (FIG. 1). If the gun were to be fired at this moment, it would, of course, miss the target because it must be offset by some amount determined by the signal entitled desired ballistic offset. The gun is offset in the following manner. The ballistic offset information is fixed (it will be assumed that the tank is stationary relative to the target so that range to target, a part of ballistic offset, is not changing). Therefore, the ballistic offset signal is combined with a zero position error voltage signal from integrator 64, causing a non-zero signal to be applied to summing node circuit 63 and, therefore, summing nodes 80 and 82, a servo 88, and actuator 90 to drive gun 24 in the desired direction to effect the ballistic offset.

When the gun is moving, gun gyro 40 produces a signal corresponding to the rate of gun movement which causes a non-zero rate related signal to be applied to summing node circuit 60 and, therefore, integrator 64. Integrator 64 integrates the non-zero signal applied thereto as the gun moves producing a voltage signal of increasing magnitude with time. As the gun is moving, the output signal from integrator 64, which changes in magnitude at the same rate that the gun is moving, is applied to yoke 70 causing the CRT 48*a* image to scroll at the same rate at which gun 24 is moving but in the opposite direction. The result is that the TV image is stationary even though gun 24 and, therefore, camera 44 are moving.

As gun 24 continues to move as a result of the ballistic offset signal, the signal from the integrator continues to change until it is equal in magnitude to and opposite in polarity from the desired ballistic offset signal at which time the final position error signal becomes zero. As a result gun 24 stops moving, misaligned with the target 28 by the amount of the ballistic offset. It will be realized that the gun cannot stop moving instantaneously but rather, in accordance with conventional servo theory, oscillates in a damped manner causing an ever decreasing amplitude alternating signal to be produced from summing node circuit 60. For purposees of discussion, however, it will be assumed that the gun instantaneously stops when it arrives at the proper position resulting in a zero signal from summing node circuit 60. The zero amplitude final position error signal from summing node circuit 66 is applied to the inverting input of AND gate 68 appearing to the AND gate as a logic one. If at that time or thereafter fire control button 72 is depressed, the resulting logic one output from AND gate 68 (via circuitry not shown) causes gun 24 to be fired. Meanwhile, on CRT 48*a* target 28 remains stationary and aligned with reticle 54 (FIG. 1).

The second phase, gun 24 nominally misaligned with the target only by the amount of the desired ballistic offset but bouncing around, is really an extension of the first phase in which the gun is finally positioned to provide for desired ballistic offset. The second phase relates to realistic operation when the tank is in motion. In the second phase control handle 30 is positioned such as to indicate no desired motion of the gun 24. Therefore, a zero signal is applied to the plus (+) input of summing node 60. Since gun 24 and thus camera 44 are in motion, gun gyro 40 produces an alternating signal, which is converted to a direct current signal by converter circuit 62 and is applied to the minus (−) input of summing node circuit 60.

The polarity of the signal produced by converter circuit 62 depends on the direction of gun motion. Thus, by way of example, when the gun is pivoting upward, or to the left, respective converter circuit signals might be positive and when the gun is pivoting downward or to the right respective converter circuit signals might be negative. In any event, the resulting signal be it positive or negative produced by summing node circuit 60 is applied to integrator 64. The resulting integrated signal represents position error of the gun relative to its nominal position, misaligned with target 28 by the amount of desired ballistic offset, is applied to yoke 70 to scroll the image as seen by camera 44 on CRT 48*a* in a direction opposite to that of gun 24 movement and therefore camera 44 movement. Therefore, the image on CRT 48*a* appears stable even though gun 24 is bouncing around.

The system parameters are adjustable such that, at instants when gun 24 is misaligned from the desired target only by the amount of desired ballistic offset, integrator 24 will produce a signal equal in magnitude to and of opposite polarity from the desired ballistic offset signal resulting in a zero final position error signal. If at any of those instants in time, fire control button 72 is in a depressed condition, having been depressed at the instant a zero final position signal occurs or previously depressed and held depressed when a zero final position error signal occurs AND gate 68 is enabled producing a pulse which is applied to the fire control circuits and the gun is fired.

In the third phase, gun 24 being positioned to a target, control handle 30 is moved by an operator (not shown) to indicate a direction and rate of movement of gun 24. The resulting signal from control handle 30 is summed at summing node circit 60 with a signal indicative of the actual rate of movement of gun 24. The error signal, if any, from summing node circuit 60 is applied through summing node circit 63, 80 and 82, servo 88 and actuator 90 to speed up or slow down the rate of gun movement to the desired rate.

When the desired rate as set by control handle 30 is equal to the actual rate as indicated by gun gyro 40, a zero position error signal is produced by integrator 64 and the scene as viewed on CRT 48*a* simply moves as the gun 24 and, therefore, camera 44 moves providing a smooth motion as viewed on CRT 48*a*.

If the gun is moving at a different rate than is desired as indicated by the position of control handle 30, such as when the control handle is first moved or due to the gun bouncing around as it is being purposely moved, a non-zero signal is produced by summing node circuit 60 which is integrated by integrator 64 and applied to yoke 70. The signal thus applied to yoke 70 causes a scene on CRT 48*a* to scroll in such a direction to compensate for the error in rate of movement of gun 24 and thus camera 44. The result is that the scene only appears to be moving based on commands from control handle 30 even though the gun may be oscillating about the desired rate of movement due to bouncing around.

When the gun while in motion under control of control handle 30 appears to be in line with the target, the control handle can be positioned to a zero desired rate of movement at which time the image on the screen will appear stationary (except for motion due to forward motion of the tank) even though the gun is bouncing around and/or changing to compensate for a desired ballistic offset as indicated in accordance with the description of phases one and two above. At this time if it is desired to fire the gun, fire control button 72 may be depressed and held depressed until thereafter the gun is actually misaligned with the target only by the amount of desired ballistic offset at which time a zero final position error signal will occur.

It will thus be understood that with the inventive system it is not required that a very high stability of the gun be maintained. The only requirement is that the gun be maintained to such stability as will cause a non-moving scene to appear on CRT screen 48*a*, the size of the screen and the size of the image as viewed by camera 44.

It should be realized that the invention is not limited to tank guns but rather may also be utilized in other situations where a workpiece needs to be aligned with a target that is bouncing around or oscillating. Thus, in a factory using robots to drop workpieces into or onto some mating part, in the prior art, it is necessary that the robot arm holding the part come to a stop aligned with the mating part. In accordance with the invention, the workpiece only needs to become temporarily aligned with the part as rated by a human operator or electronics which is the equivalent of control handle 30 (FIG. 2) being placed at a zero error setting. The camera 44 is mounted on the robot arm which holds the workpiece. Then or thereafter, when the workpiece is aligned with the mating piece and moving slow enough to satisfy system constraints, a signal equivalent to the signal produced by AND gate 68 can be issued causing the robot to release the workpiece.

I claim:

1. A system for aligning a movable workpiece with a target, comprising in combination:

an electronic scene observing first means adapted for movement with said workpiece for viewing whatever said workpiece is aligned with;

an electronic scene displaying second means coupled to said scene observing means for displaying a portion less than all of the scene viewed by said scene observing means, said scene displaying means having a control terminal responsive to a control signal for determining what portion of the observed scene is displayed;

third means producing a first signal indicative of the rate of movement of said workpiece;

fourth means producing a second signal indicative of the desired rate of movement of said workpiece; and fifth means responsive to said first signal and second signal for providing to said control terminal said control signal for causing said image displayed on said displaying means to move only at a rate set by said fourth means whereby when said fourth means is set to indicate a zero rate of movement of said first means the displayed image is stationary even though said first means may be in motion.

2. The combination as set forth in claim 1 wherein said third means comprises a rate gyro coupled to said workpiece to indicate of the rate of movement thereof.

3. The combination as set forth in claim 1 wherein said fifth means comprises means receptive of said first and second rate signals for producing a signal which is the difference between said desired rate and actual rate of motion of said workpiece and means responsive to the difference signal for integrating the difference signal to produce a signal indicative of position of said workpiece with respect to the desired position as a function of time.

4. The combination as set forth in claim 1 further including means responsive to the difference between said first and second signals for moving said workpiece in a direction to decrease the difference therebetween.

5. The combination as set forth in claim 1 wherein said first means comprises a video camera.

6. The combination as set forth in claim 5 wherein said second means comprises a video display device.

7. The combination as set forth in claim 6 wherein said video display device comprises a cathode ray tube (CRT) and means including said control terminal for positioning on said CRT display face a portion of the scene viewed by said first means, said portion being determined by the value of said control signal applied to said control terminal.

8. A system for permitting alignment between a movable gun and a desired target, comprising in combination:

an electronic scene observing first means mounted for movement with said gun for viewing a scene nominally centered about whatever said gun is pointing toward;

an electronic scene displaying second means for displaying to an operator a portion less than all of whatever scene is observed by said first means, said second means also including a control terminal receptive of a control signal for determining which portion of the viewed scene is to be displayed;

third means coupled to said gun for producing a first signal indicative of the actual rate of movement of said gun;

a control handle fourth means producing a second signal corresponding to the desired rate of movement of said gun; and fifth means responsive to said first signal and second signal for producing said control signal for causing said viewed image to move only at a rate set by said fourth means whereby when said fourth means is set to indicate a zero rate of movement of said first means the displayed image is stationary even though said first means may be in motion.

9. The combination as set forth in claim 8 wherein said third means comprises a rate gyro coupled to said gun to indicate of the rate of movement thereof.

10. The combination as set forth in claim 8 wherein said fifth means comprises means receptive of said first and second rate signals for producing a signal which is the difference between said desired rate and actual rate of motion of said gun and means responsive to the difference signal for integrating the difference signal to produce a signal indicative of position error of said gun.

11. The combination as set forth in claim 8 further including means responsive to the difference between said first and second signals for moving said gun in a direction to decrease the difference therebetween.

12. The combination as set forth in claim 8 wherein said first means comprises a video camera.

13. The combination as set forth in claim 12 wherein said second means comprises a video display device.

14. The combination as set forth in claim 13 wherein said video display device comprises a cathode ray tube (CRT) and means including said control terminal for positioning on said CRT display face a portion of the scene viewed by said first means, said portion being determined by the value of said control signal applied to said control terminal.

* * * * *